US011614094B2

(12) United States Patent
Li

(10) Patent No.: US 11,614,094 B2
(45) Date of Patent: Mar. 28, 2023

(54) INTEGRAL FAN BLADE, FAN AND FAN LAMP THEREOF

(71) Applicant: Min Li, Chongqing (CN)

(72) Inventor: Min Li, Chongqing (CN)

( * ) Notice: Subject to any disclaimer, the term of this patent is extended or adjusted under 35 U.S.C. 154(b) by 34 days.

(21) Appl. No.: 17/334,198

(22) Filed: May 28, 2021

(65) Prior Publication Data

US 2021/0372425 A1 Dec. 2, 2021

(30) Foreign Application Priority Data

Jun. 2, 2020 (CN) ..... 202020981829.5

(51) Int. Cl.

| | |
|---|---|
| ***F04D 29/28*** | (2006.01) |
| ***F04D 17/16*** | (2006.01) |
| ***F04D 25/08*** | (2006.01) |
| ***F21V 33/00*** | (2006.01) |

(52) U.S. Cl.

CPC ..... *F04D 29/281* (2013.01); *F04D 17/165* (2013.01); *F04D 25/088* (2013.01); *F21V 33/0096* (2013.01)

(58) Field of Classification Search

CPC .. F21V 33/0096; F04D 29/325; F04D 25/088; F04D 17/165

See application file for complete search history.

(56) References Cited

U.S. PATENT DOCUMENTS

| | | | | |
|---|---|---|---|---|
| 5,421,701 | A * | 6/1995 | Funston | F04D 25/022 416/5 |
| 6,575,585 | B2 * | 6/2003 | Nelson | F21V 33/008 362/276 |
| 9,115,724 | B2 * | 8/2015 | Chen | F04D 25/088 |
| 2007/0247854 | A1 * | 10/2007 | Lin | F21V 33/0096 362/147 |

* cited by examiner

*Primary Examiner* — Woody A Lee, Jr.
*Assistant Examiner* — Brian O Peters

(57) ABSTRACT

An integral fan blade includes a fan blade connecting disk and a plurality of fan blade bodies arranged around and equidistantly surrounding the fan blade connecting disk. The fan blade bodies and the fan blade connecting disk are integrally formed. This design allows the wind angle to cover a cone-shaped area from top to bottom. Under the same specifications, the wind force is relatively larger than ordinary conventional fan blades, and the coverage area is also larger, thus bringing better blowing effect and better use effect to users.

8 Claims, 7 Drawing Sheets

INTEGRAL FAN BLADE, FAN AND FAN LAMP THEREOF

TECHNICAL FIELD

The present disclosure relates to the technical field of fans, and in particular, to an integral fan blade, and a fan and fan lamp using the integral fan blade.

BACKGROUND

Existing fan blades are mostly divided into two types according to their air intake ways. One is the impeller-type fan blades with air intake on the side, it is mainly used in some industries and some work scenes that require concentrated wind and more power. The other is the conventional fan blades with air intake in the back and air outtake in the front. This kind of fan blades are generally used in conventional fans such as household seat fans and ceiling fans.

SUMMARY

The present disclosure is mainly intended to provide an integral fan blade with good blowing effect.

Another object of the present disclosure is to provide a fan and a fan lamp using the above integral fan blades.

The present disclosure provides an integral fan blade, comprising a fan blade connecting disk, and a plurality of fan blade bodies arranged around and equidistantly surrounding the fan blade connecting disk, wherein each of the plurality of fan blade bodies comprises an upper fan blade and a lower fan blade, the upper fan blade is bent downward, and the lower fan blade is bent upward; a bottom of the upper fan and a top of the lower fan are connected to form the each of the plurality of fan blade bodies with a hood shape.

In a preferred embodiment, the upper fan blade and the lower fan blade are integrally formed.

In a preferred embodiment, the plurality of fan blade bodies and the fan blade connecting disk are integrally formed.

In a preferred embodiment, the upper fan blade is larger and the lower fan blade is smaller, and an opening with a hood shape is inclined downward.

In a preferred embodiment, the edges of the upper fan blade and the lower fan blade are arc-shaped.

In a preferred embodiment, the fan blade connecting disk is provided with a connecting hole at a middle, the fan blade connecting disk is connected to an output shaft of a motor through the connecting hole.

In a preferred embodiment, the connecting hole at the middle of the fan blade connecting disk is provided with a plurality of fan blade fixing holes around, and the fan blade connecting disk is fixed on the output shaft through the fan blade fixing holes.

A fan comprises a base, a decorative cover, and an integral fan blade; the base is installed with an assembly, a motor and a control circuit above the base; an output shaft of the motor passes through a center hole of the base and is located below the base; the integral fan blade is located below the base, an fan blade connecting disk of the integral fan blade is installed on the output shaft of the motor; the decorative cover is installed below the base and is provided outside the integral fan blade.

A fan lamp comprises a base, a chassis, a light source, a lampshade, a decorative cover, and an integral fan blade; the base is installed with an assembly, a motor and a control circuit on the base, an output shaft of the motor passes through a center hole of the base and is located below the base; the base is provided with a plurality of support rods extending outwards around the base, the chassis and the lampshade are in an annular shape, and the chassis is installed outside ends of the support rods, the light source is installed on the chassis and electrically connected to the control circuit through a wire, the lampshade is installed on the chassis and covers on the light source; the integral fan blade is located below the base, an fan blade connecting disk of the integral fan blade is installed on the output shaft of the motor; the decorative cover is installed below the base and is provided outside the integral fan blade.

The support rods are inclined downwardly with the base as a center, and at least one support rod is formed with a wire groove, the wire configured to connect the lamp and the control circuit is laid in the wire groove; the integral fan blade is located in a space enclosed by the base, the support rods, the chassis and the decorative cover; an opening with a hood shape of the integral fan blade is slightly lower than the lampshade.

The beneficial effects of the present disclosure are:

The integral fan blade of the present disclosure includes a fan blade connecting disk and a plurality of fan blade bodies arranged around the fan blade connecting disk and equidistantly surrounding the fan blade connecting disk. The fan blade bodies and the fan blade connecting disk are also integrally formed. Through the use of an integral fan blade design, the air outtake angle can cover a cone-shaped area from top to bottom. Under the same specifications, the wind force is relatively larger than the general conventional fan blade, and the coverage area is also larger, so as to bring users better blowing effect, and better use effect.

100, fan lamp;

10, integral fan blade; 1, fan blade connecting disk; 11, connecting hole; 12, fan blade fixing hole; 2, fan blade body; 21, upper fan blade; 22, lower fan blade; 3, blade cap;

20, motor;

30, assembly; 31, hanging plate; 32, flange;

40, base; 41, center hole; 42, support rod; 43, wire groove; 431, wire inlet; 432, wire outlet;

50, chassis; 51, wire hole; 52, positioning hole;

60, light source;

70, lampshade;

80, decorative cover; 81, lug;

90, control circuit; 91, wire.

DESCRIPTION OF EMBODIMENTS

It should be understood that the specific embodiments described here are only used to explain the present disclosure, but not to limit the present disclosure.

Figure 1:
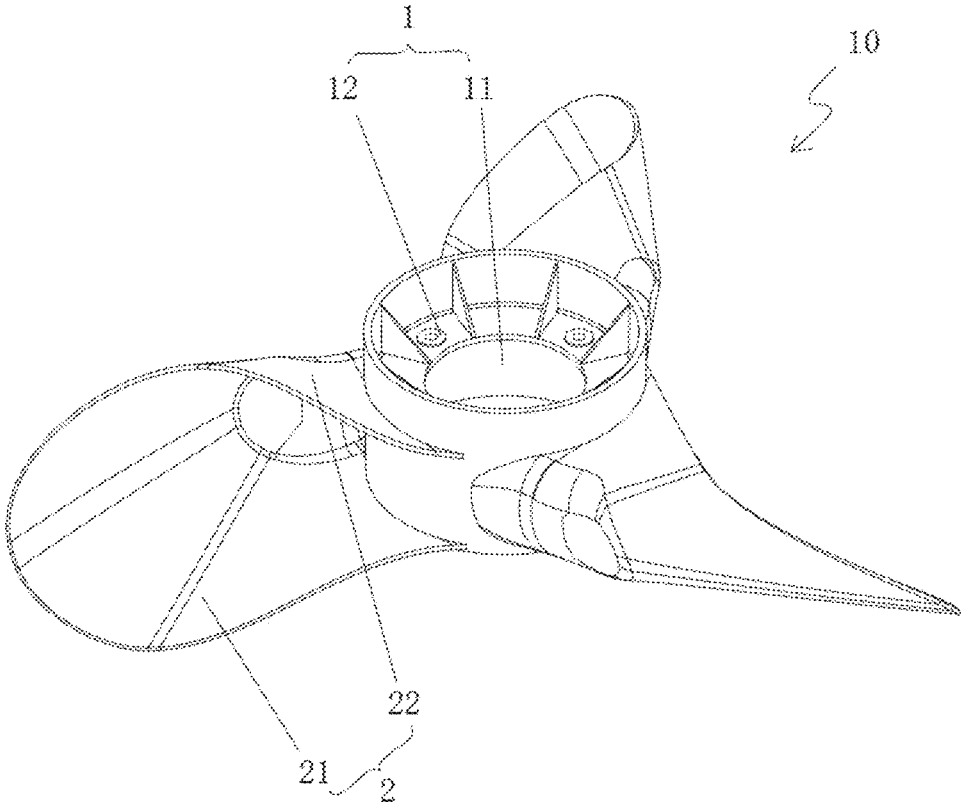
FIG. 1 is a bottom perspective view showing an integral fan blade according to the present disclosure.
Figure 2:
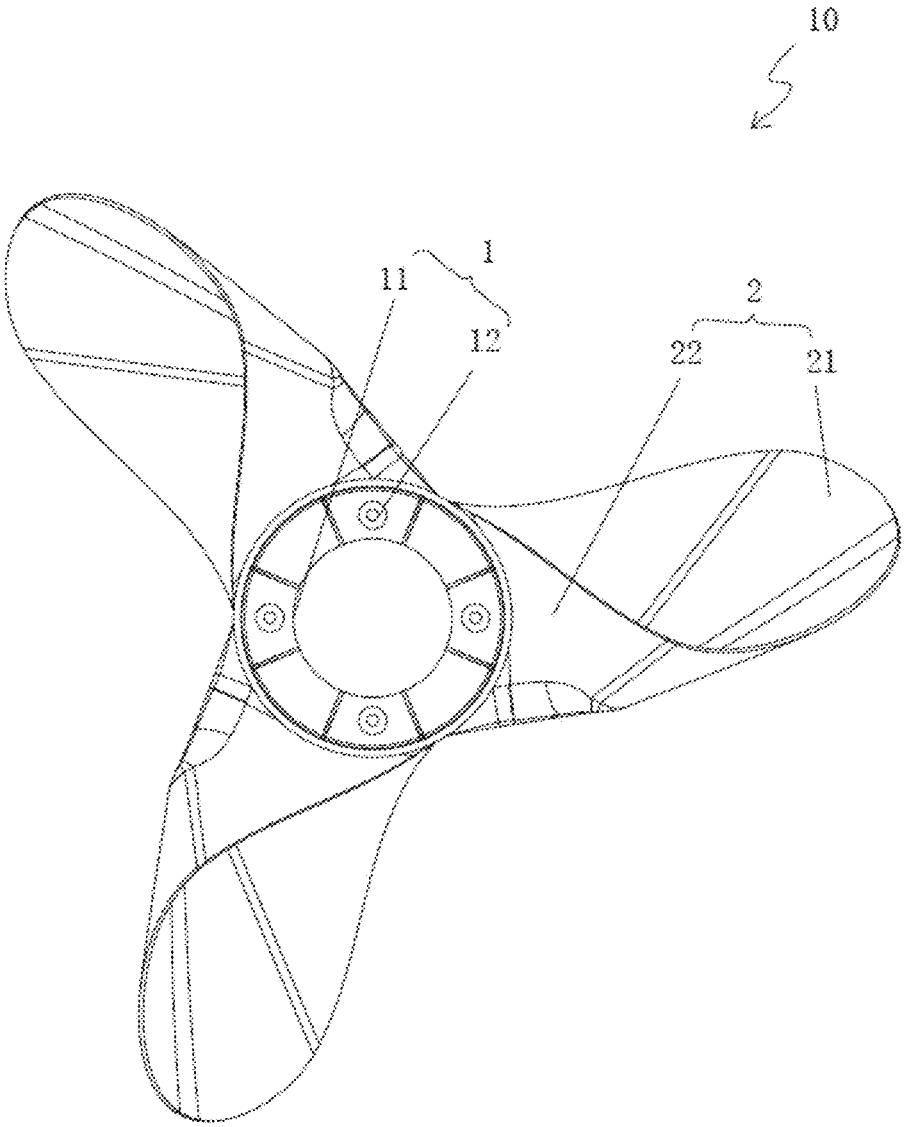
FIG. 2 is a bottom view showing an integral fan blade according to the present disclosure.

Referring to FIGS. 1 to 2, it is an embodiment of the integral fan blade of the present disclosure:

An integral fan blade 10 may include a fan blade connecting disk 1 and a plurality of fan blade bodies 2 arranged around the fan blade connecting disk 1 and equidistantly surrounding the fan blade connecting disk 1.

In the present embodiment, three fan blade bodies 2 may be provided. Each of the fan blade bodies 2 may include an upper fan blade 21 and a lower fan blade 22. The upper fan blade 21 may be bent downward, the lower fan blade 22 may be bent upward, and the bottom of the upper fan blade 21 may be connected to the top of the lower fan blade 22 to form a hood-shaped fan blade body 2. The upper fan blade 21 and the lower fan blade 22 may be integrally formed. The fan blade bodies 2 and the fan blade connecting disk 1 may be also integrally formed. The upper fan blade 21 has a larger area and the lower fan blade 22 has a smaller area, so that the hood-shaped opening may be inclined downward. The edges of the upper fan blade 21 and the lower fan blade 22 may be arc-shaped.

Figure 3:
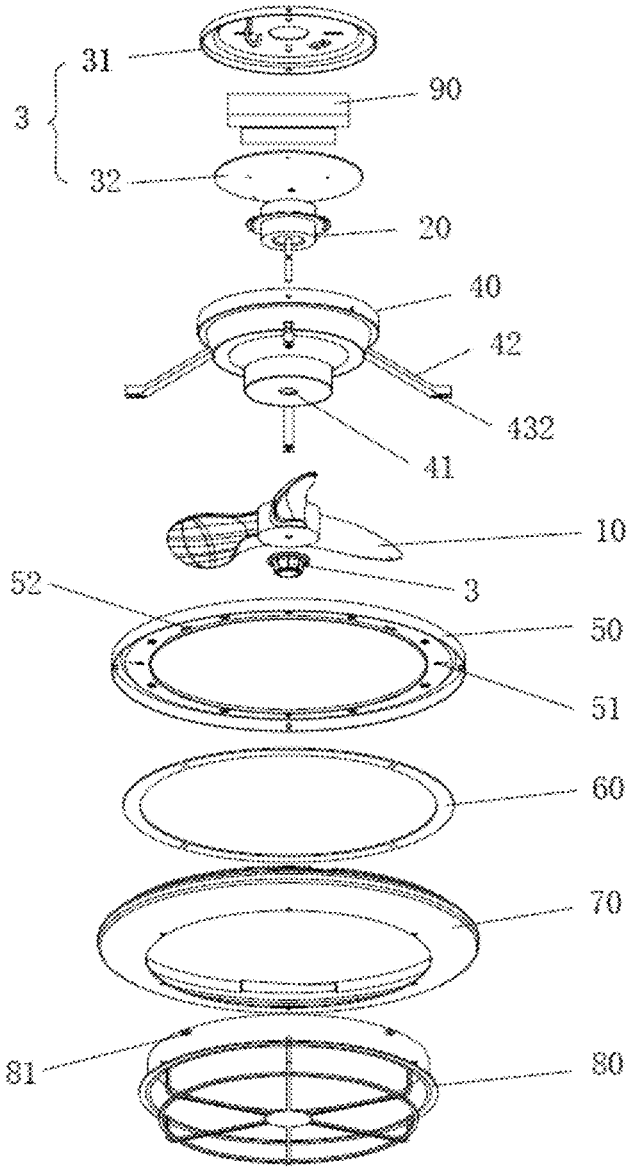
FIG. 3 is a perspective breakdown view of a fan lamp according to the present disclosure.
Figure 4:
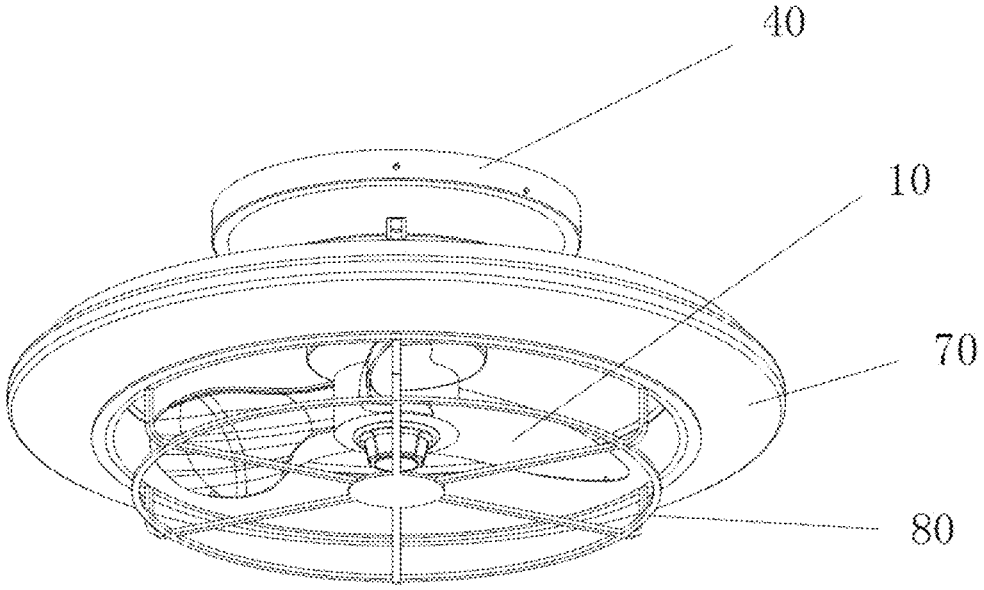
FIG. 4 is a perspective view of a fan lamp according to the present disclosure.
Figure 5:
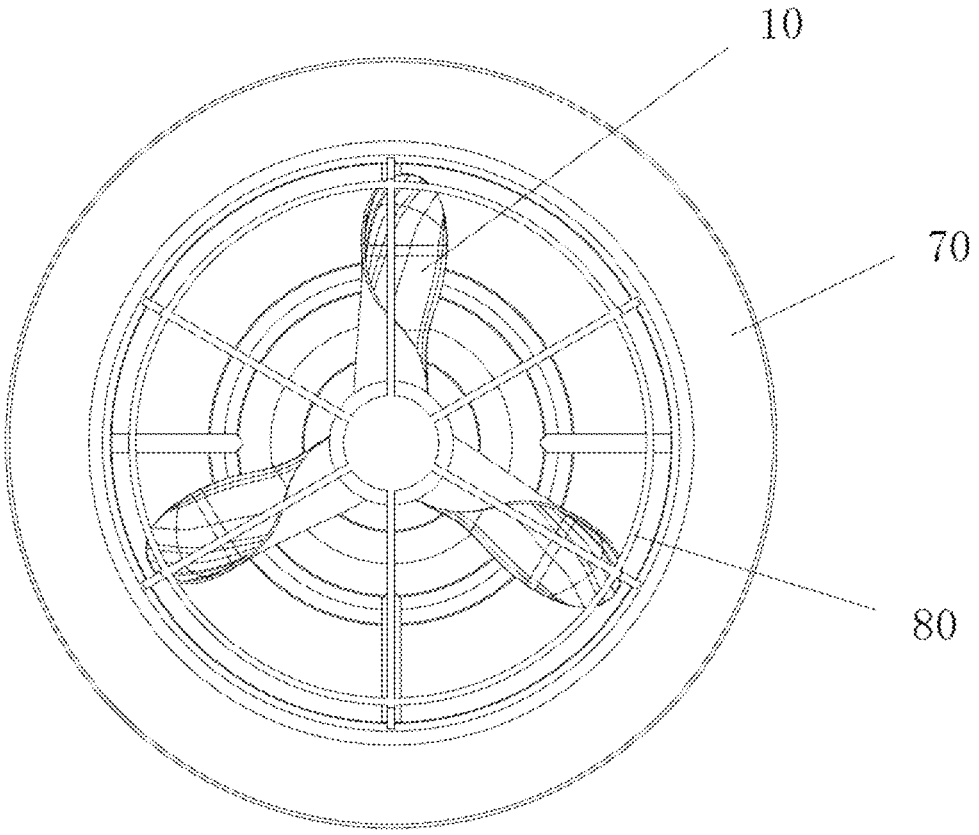
FIG. 5 is a bottom view of a fan lamp according to the present disclosure.
Figure 6:
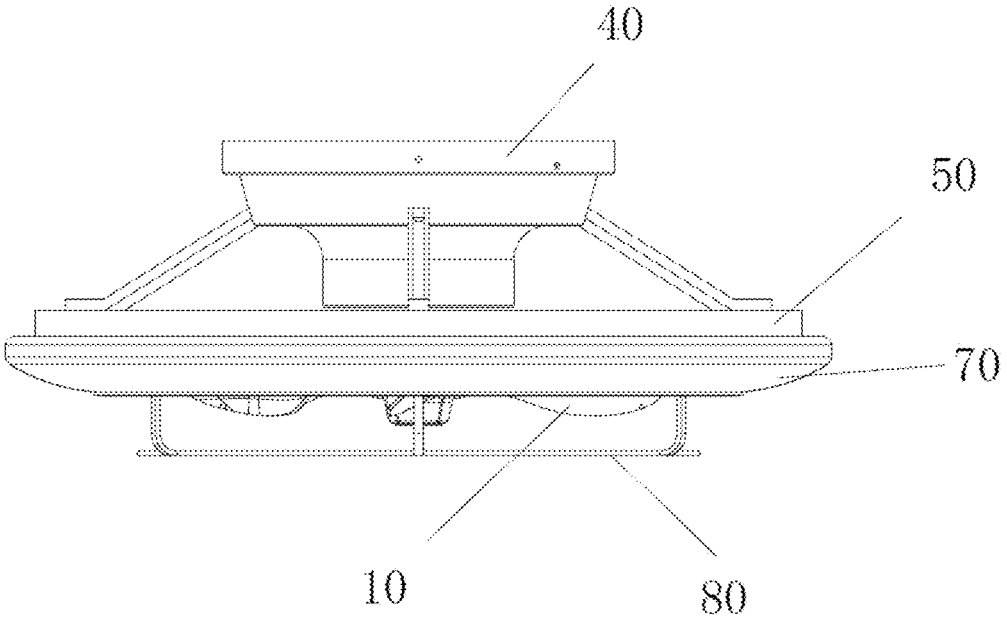
FIG. 6 is a side view of a fan lamp according to the present disclosure.
Figure 7:
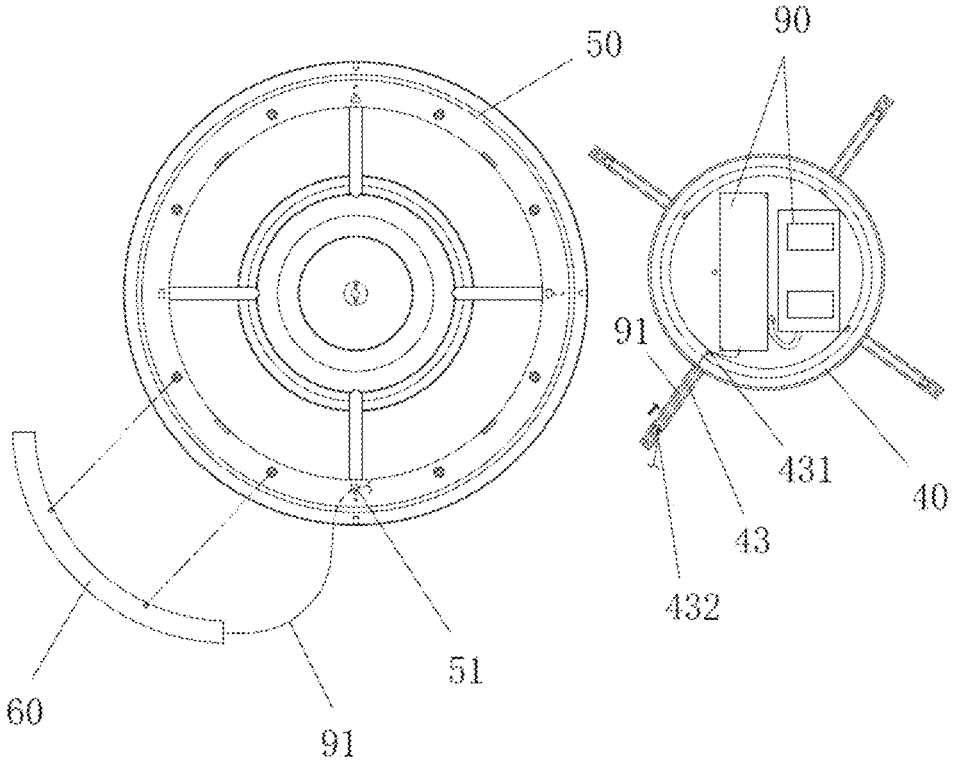
FIG. 7 is a connection diagram of the light source and the control circuit according to the present disclosure.

A connecting hole 11 may be provided in the middle of the fan blade connecting disk 1, and the fan connecting disk 1 may be connected to the output shaft of the motor 20 through the connecting hole 11. As shown in FIG. 3, a plurality of fan blade fixing holes 12 may be provided around the connecting holes 11 at the middle of the fan blade connecting disk 1. The fan blade fixing hole 12 may be used to fix the fan blade connecting disk 1 on the output shaft, to prevent the fan blade from moving back and forth.

By using the special design of the integral fan blade 10, the air outlet angle can cover a cone-shaped area from top to bottom. Under the same specifications, the wind force may be relatively larger than the general conventional fan blade, and the coverage area may be also larger, so as to bring customers better blowing effect, and better use effect.

Referring to FIGS. 3-7, an embodiment of the integral fan blade of the present disclosure applied to the fan lamp 100 is shown:

A fan lamp 100 may include a base 40, an integral fan blade 10, a chassis 50, a light source 60, a lampshade 70 and a decorative cover 80. The base 40 may be installed with an assembly 30, a motor 20 and a control circuit 90 thereon. The output shaft of the motor 20 may pass through the center hole 41 of the base 40 and may be located below the base 40. The assembly 30 may be used to install and fix the entire fan lamp 100. The assembly 30 may be usually composed of a hanging plate 31 and a flange 32. Specifically, the hanging plate 31 can be installed on a suitable position such as the roof, and the motor 20 may be installed on the base 40, and then the flange 32 may be installed on the base 40, so that the motor 20 is located between the base 40 and the flange 32; and then the control circuit 90 may be installed on the flange 32, the base 40 may be installed on the hanging plate 31, the control circuit 90 can include a module for driving the motor 20, a module for supplying power to the light source 60, a remote control module, and so on based on the functional design needs. A plurality of support rods 42 extending outward may be provided on the periphery of the base 40. The chassis 50 and the lampshade 70 may be in a circular ring shape, and the chassis 50 may be mounted on the outer end of the support rod 42. The light source 60 may be installed on the chassis 50, and the specific shape of the light source 60 can be several lamp beads, a multi-segment light bar, or an entire ring light bar, and so on. The light source 60 may be electrically connected to the control circuit 90 through a wire 91. The lampshade 70 may be installed on the chassis 50 and covered on the light source 60. The integral fan blade 10 may be located below the base 40, and the fan blade connecting disk 1 of the integral fan blade 10 may be installed on the output shaft of the motor 20. The lower end of the output shaft may be also equipped with a blade cap 3, and a decorative cover 80 may be installed below the base 40. The decorative cover 80 can be specifically designed to be directly fixed on the chassis 50 or directly on the base 40, and the decorative cover 80 may be provided outside the integral fan blade 10. As shown in FIG. 3, at least one lug 81 with a screw hole may be formed on the decorative cover 80, and a plurality of positioning holes 52 may be formed on the chassis 50. The screw passes through the screw hole of the lug 81 of the decorative cover 80 and the positioning hole 52 of the chassis 50, to make the decorative cover 80 directly fixed on the chassis 50, so that it is convenient to replace the decorative cover 80 with different specifications according to the height of the lampshade 70.

Specifically, each the support rod 42 may be inclined downwardly with the base 40 as the center. The integral fan blade 10 may be located in the space enclosed by the base 40, the support rods 42, the chassis 50 and the decorative cover 80. The hood-shaped opening of the integral fan blade 10 may be slightly lower than the lampshade 70 to avoid blocking the wind and affecting the wind effect.

In order to facilitate the wiring of the wires 91, a wire groove 43 for laying the wires 91 may be formed on at least one support rod 42. The two ends of the wire groove 43 may be provided with a wire inlet 431 and a wire outlet 432. The chassis 50 may be provided with a plurality of wire holes 51 corresponding to the wires. One end of wire 91 may be electrically connected to the control circuit 90, and the other end passes through the wire inlet 431, the wire groove 43, the wire outlet 432, and the wire holes 51 to be electrically connected to the light source 60.

The integral fan blade of the present disclosure can also be applied to a fan without a light source, that is, a fan including a base, an integral fan blade and a decorative cover. A hanging plate, a flange, a motor and a control circuit may be installed above the base. The output shaft of the motor passes through the center hole of the base and may be located below the base. The integral fan blade may be located below the base. The fan blade connecting disk of the integral fan blade may be installed on the output shaft of the motor, and the decorative cover may be installed below the base. The decorative cover may be arranged outside the integral fan blade.

The above descriptions are only the preferred embodiments of the present disclosure, and do not limit the scope of the present disclosure. Any equivalent structural transformations made using the contents of the description and drawings of the present disclosure, or directly or indirectly applied to other related technical fields, are, in the same reason, included in the scope of patent protection of the present disclosure.

What is claimed is:

1. A fan lamp, comprising a base, a chassis, a light source, a lampshade, a decorative cover, and an integral fan blade; wherein the integral fan blade comprises a fan blade connecting disk, and a plurality of fan blade bodies arranged around and equidistantly surrounding the fan blade connecting disk, wherein each of the plurality of fan blade bodies comprises an upper fan blade and a lower fan blade, the upper fan blade is bent downward, and the lower fan blade is bent upward; a bottom of the upper fan blade and a top of the lower fan blade are connected to form the each of the plurality of fan blade bodies with a hood-like shape;

the base is installed with an assembly, a motor and a control circuit on the base, an output shaft of the motor passes through a center hole of the base and is located below the base; the base is provided with a plurality of support rods extending outwards around the base, the chassis and the lampshade are in an annular shape, and the chassis is installed outside ends of the support rods, the light source is installed on the chassis and electrically connected to the control circuit through a wire, the lampshade is installed on the chassis and covers on the light source; the integral fan blade is located below the base, an fan blade connecting disk of the integral fan blade is installed on the output shaft of the motor; the decorative cover is installed below the base, the decorative cover is provided outside the integral fan blade.

2. The fan lamp according to claim 1, wherein the support rods are inclined downwardly with the base as a center, and at least one support rod is formed with a wire groove, the wire configured to connect the lamp and the control circuit is laid in the wire groove; the integral fan blade is located in a space enclosed by the base, the support rods, the chassis and the decorative cover; an opening with a hood shape of the integral fan blade is slightly lower than the lampshade.

3. The fan lamp according to claim 1, wherein the decorative cover is formed with at least one lug with a screw hole, the chassis is formed with at least one positioning hole, and the decorative is fixed on the chassis by passing the screw through the screw hole of the at least one lug of the decorative cover and the at least one positioning hole of the chassis.

4. The fan lamp according to claim 1, wherein the upper fan blade and the lower fan blade are integrally formed.

5. The fan lamp according to claim 1, wherein the plurality of fan blade bodies and the fan blade connecting disk are integrally formed.

6. The fan lamp according to claim 1, wherein the upper fan blade is larger than the lower fan blade, and an opening with a hood-like shape is inclined downward.

7. The fan lamp according to claim 1, wherein the fan blade connecting disk is provided with a connecting hole at a middle, the fan blade connecting disk is able to be connected to an output shaft of a motor through the connecting hole.

8. The fan lamp according to claim 7, wherein the connecting hole at the middle of the fan blade connecting disk is provided with a plurality of fan blade fixing holes around, and the fan blade connecting disk is able to be fixed on the output shaft through the fan blade fixing holes.

* * * * *